US011809109B2

(12) United States Patent
Takemasa et al.

(10) Patent No.: US 11,809,109 B2
(45) Date of Patent: Nov. 7, 2023

(54) IMAGE HEATING APPARATUS HAVING A WORM THAT IS ROTATABLY SUPPORTED AT TWO DIFFERENT POSITIONS

(71) Applicant: Canon Kabushiki Kaisha, Tokyo (JP)

(72) Inventors: Rikiya Takemasa, Chiba (JP); Takeshi Kozuma, Tokyo (JP); Youichi Chikugo, Chiba (JP); Yutaro Tsuno, Tokyo (JP); Hidekazu Tatezawa, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/363,486

(22) Filed: Jun. 30, 2021

(65) Prior Publication Data

US 2022/0004129 A1 Jan. 6, 2022

(30) Foreign Application Priority Data

Jul. 2, 2020 (JP) ..... 2020-114840
Jun. 18, 2021 (JP) ..... 2021-101534

(51) Int. Cl.
*G03G 15/20* (2006.01)

(52) U.S. Cl.
CPC ..... *G03G 15/2053* (2013.01); *G03G 15/2032* (2013.01); *G03G 2215/2038* (2013.01)

(58) Field of Classification Search
CPC ..... G03G 15/2032; G03G 15/2038
See application file for complete search history.

(56) References Cited

U.S. PATENT DOCUMENTS 8,051,737 B2 * 11/2011 Li ..... F16H 57/039 74/425
10,520,868 B1 * 12/2019 Tomita ..... G03G 15/2053
2010/0329729 A1 * 12/2010 Koshida ..... G03G 21/1685 399/110
2016/0170342 A1 * 6/2016 Yoshimura ..... G03G 15/2028 399/327
2020/0192258 A1 * 6/2020 Sakurai ..... G03G 15/2053
2021/0088945 A1 * 3/2021 Hashimura ..... G03G 15/2064

FOREIGN PATENT DOCUMENTS

JP 2000234507 A 8/2000
JP 2001108026 A 4/2001
JP 2009198949 A 9/2009

* cited by examiner

*Primary Examiner* — Arlene Heredia
(74) *Attorney, Agent, or Firm* — Venable LLP

(57) ABSTRACT

An image heating apparatus includes a first rotary member and a second rotary member that form a nip portion, and, a changing mechanism configured to change a pressing force applied at the nip portion. The changing mechanism includes a worm having both ends supported rotatably, a worm wheel that is meshed with the worm and to which a driving force from the worm is transmitted, a rotatable shaft to which the worm wheel is attached, a cam that is attached to the shaft, and, a displacement mechanism that is abutted against the cam and that is configured to displace the second rotary member with respect to the first rotary member along with a rotation of the cam.

27 Claims, 13 Drawing Sheets

IMAGE HEATING APPARATUS HAVING A WORM THAT IS ROTATABLY SUPPORTED AT TWO DIFFERENT POSITIONS

BACKGROUND OF THE INVENTION

Field of the Invention

The present invention relates to an image heating apparatus for heating an image on a recording material.

Description of the Related Art

Hitherto, there has been known a fixing unit serving as an image heating apparatus that adopts a configuration equipped with a cam for changing a pressing force of a nip portion formed by a heating roller and a pressure roller. Further, a configuration has been proposed in which a clutch for blocking transmission of a reaction force from a cam to a driving source is provided in a drive transmission device for transmitting a drive from the driving source to the cam (Japanese Patent Application Laid-Open Publication No. 2009-198949).

According to the configuration disclosed in Japanese Patent Application Laid-Open Publication No. 2009-198949, a clutch is provided to prevent the reaction force from the cam from being transmitted to the driving source. Therefore, the costs of the drive transmission device are increased, and the size of the device is also increased in order to provide the clutch.

SUMMARY OF THE INVENTION

The present invention provides a configuration for suppressing increase in size and costs of the device while suppressing transmission of reaction force from a cam to a driving source.

According to a first aspect of the present invention, an image beating apparatus includes a first rotary member and a second rotary member that form a nip portion configured to nip and convey a recording material to heat an image on the recording material, and, a changing mechanism configured to change a pressing force applied at the nip portion by changing a position of the second rotary member with respect to the first rotary member. The changing mechanism includes a motor, a first drive transmission member that is attached to a shaft of the motor, a worm having both ends supported rotatably, a second drive transmission member that is attached to a first end of the worm in a rotational axis direction of the worm and to which a driving force from the first drive transmission member is transmitted, a worm wheel that is meshed with the worm and to which a driving force from the worm is transmitted, a rotatable shaft to which the worm wheel is attached, a cam that is attached to the shaft, and, a displacement mechanism that is abutted against the cam and that is configured to displace the second rotary member with respect to the first rotary member along with a rotation of the cam.

According to a second aspect of the present invention, an image heating apparatus includes a first rotary member and a second rotary member that form a nip portion configured to nip and convey a recording material to heat an image on the recording material, and, a changing mechanism configured to change between application of pressure and releasing of application of pressure at the nip portion by changing a position of the second rotary member with respect to the first rotary member. The changing mechanism includes a motor, a first drive transmission member that is attached to a shaft of the motor, a worm having both ends supported rotatably, a second drive transmission member that is attached to a first end of the worm in a rotational axis direction of the worm and to which a driving force from the first drive transmission member is transmitted, a worm wheel that is meshed with the worm and to which a driving force from the worm is transmitted, a rotatable shaft to which the worm wheel is attached, a cam that is attached to the shaft, and, a displacement mechanism that is abutted against the cam and that is configured to displace the second rotary member with respect to the first rotary member along with a rotation of the cam.

Further features of the present invention will become apparent from the following deception of exemplary embodiments with reference to the attached drawings.

DESCRIPTION OF THE EMBODIMENTS

Figure 1:
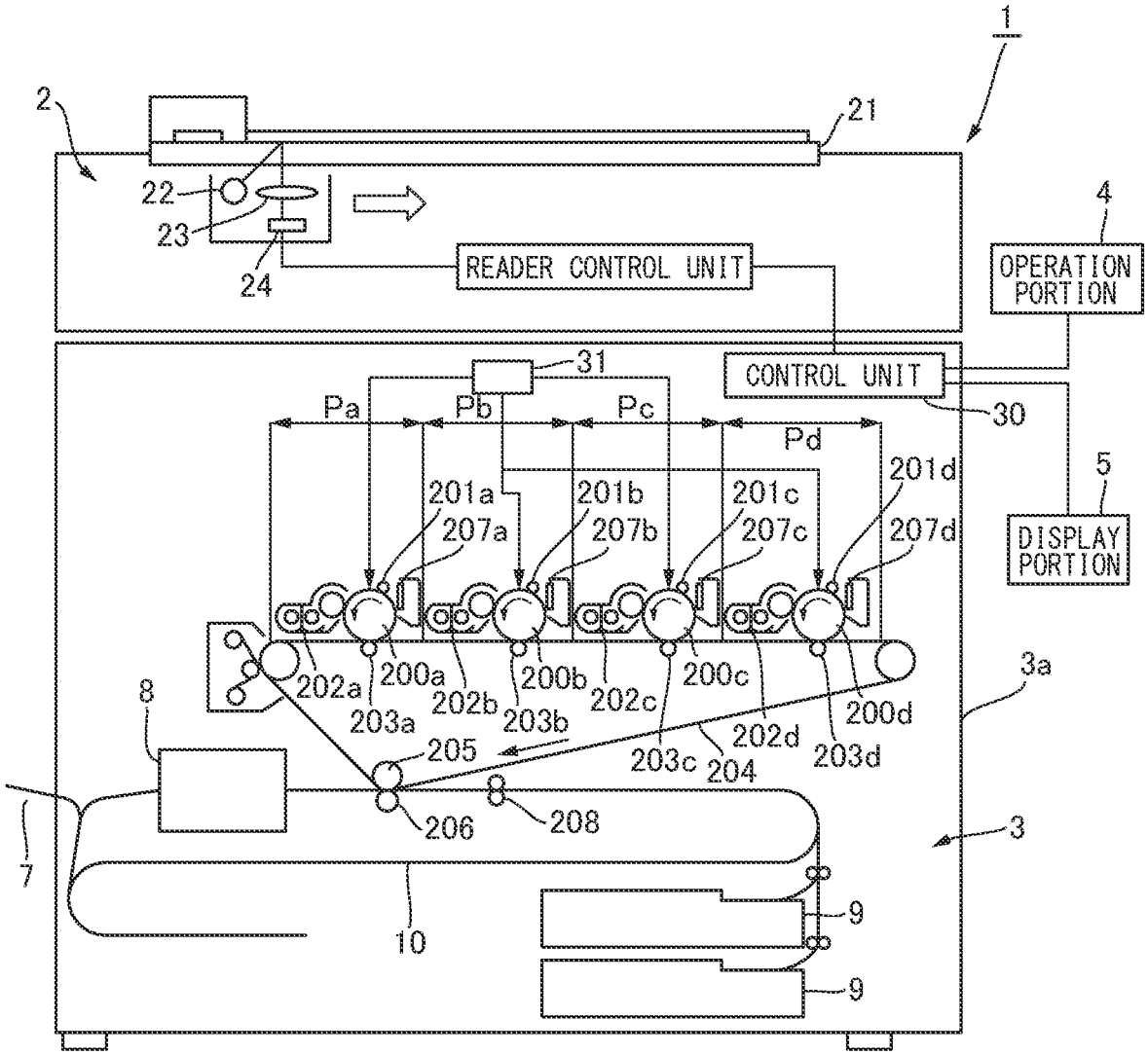
FIG. 1 is a schematic cross-sectional view of an image forming apparatus according to an embodiment.

An embodiment will be described with reference to FIGS. 1 through 13. At first a schematic configuration of an image forming apparatus according to the present embodiment will be described with reference to FIG. 1.

Image Forming Apparatus

An image forming apparatus 1 is a full-color printer adopting an electrophotographic system including four image forming units Pa, Pb, Pc and Pd that are provided in correspondence to four colors, which are yellow, magenta, cyan and black. In the present embodiment, a so-called tandem-type system is adopted in which the image forming units Pa. Pb, Pc and Pd are arranged along a rotational direction of an intermediate transfer belt 204 described later. The image forming apparatus 1 forms a toner image on a recording material in response to an image signal from an image reading unit, i.e., document reading apparatus, 2 connected to an image forming apparatus body 3 or from a host device such as a personal computer connected in a manner capable of communicating with the image forming apparatus body 3. The recording material can be various types of sheet materials, such as paper, plastic film, and cloth.

The image forming apparatus 1 includes the image reading unit 2 and the image forming apparatus body 3. The image reading unit 2 reads a document placed on a platen glass 21, where light emitted from a light source 22 is reflected on the document and forms an image on a CCD sensor 24 via an optical member 23 such as a lens. Such an optical unit scans the document in an arrow direction to convert the document into electric signal data arrays corresponding to each line. The image signal obtained by the CCD sensor 24 is transmitted to the image forming apparatus body 3, where image processing corresponding to image forming units described later is performed in a control unit 30. Further, the control unit 30 also receives image signals as external input from an external host device such as a print server.

The image forming apparatus body 3 includes a plurality of image forming units Pa, Pb, Pc and Pd, and image is formed in each image forming unit based on the image signal described above. That is, the image signal is converted into a laser beam subjected to PWM (pulse width modulation control) by the control unit 30. A polygon scanner 31 serving as an exposing unit scans the laser beam according to the image signal. The laser beam is irradiated to photosensitive drums 200*a* to 200*d* which serve as image bearing members of the respective image forming units Pa to Pd.

Images of corresponding colors are formed respectively in the image forming unit Pa for yellow (Y), the image forming unit Pb for magenta (M), the image forming unit Pc for cyan (C) and the image forming unit Pd for black (Bk). The image forming units Pa to Pd adopt a similar configuration, so that only the details of the image forming unit Pa for Y is described below and details of other image forming units are omitted. In the image forming unit Pa, a toner image is formed on a surface of a photosensitive drum 200*a* based on an image signal, as described hereafter.

A charging roller 201*a* serving as a primary charger charges a surface of the photosensitive drum 200*a* to a predetermined potential to prepare for the formation of an electrostatic latent image. An electrostatic latent image is formed on the surface of the photosensitive drum 200*a* charged to predetermined potential by a laser beam emitted from the polygon scanner 31. A developing unit 202*a* develops the electrostatic latent image formed on the photosensitive drum 200*a* and forms a toner image. A primary transfer roller 203*a* performs electric discharge from a rear side of the intermediate transfer belt 204 to apply a primary transfer bias having an opposite polarity as toner and transfers the toner image formed on the photosensitive drum 200*a* to the intermediate transfer belt 204. The surface of the photosensitive drum 200*a* after transfer is cleaned by a cleaner 207*a*.

The toner image on the intermediate transfer belt 204 is conveyed to subsequent image forming units, where toner images of respective colors of Y. M. C and Bk formed in the respective image forming units are transferred sequentially in the named order, by which a four-color image is formed on the surface of the intermediate transfer belt 204. The toner image having passed through the Bk image forming unit Pd arranged most downstream in a rotating direction of the intermediate transfer belt 204 is conveyed to a secondary transfer portion composed of the secondary transfer roller pair 205 and 206. Then, a secondary transfer electric field having opposite polarity as the toner image formed on the intermediate transfer belt 204 is applied at the secondary transfer portion, by which the toner image is secondarily transferred to the recording material.

The recording material is stored in a cassette 9, the recording material fed from the cassette 9 is conveyed to a registration portion 208 composed of a pair of registration rollers, and the recording material is set to standby at the registration portion 208. Thereafter, the registration portion 208 is subjected to timing control so that the position of the paper corresponds to the timing of the toner image on the intermediate transfer belt 204 when the recording material is conveyed to the secondary transfer portion.

The recording material to which the toner image has been transferred at the secondary transfer portion is conveyed to a fixing unit 8 and subjected to heat and pressure at the fixing unit 8, by which the toner image borne on the recording material is fixed to the recording material. The recording material having passed through the fixing unit 8 is discharged to a sheet discharge tray 7. When images are to be formed on both sides of the recording material, after transferring and fixing the toner image to a first surface, i.e., front surface, of the recording material, the recording material is passed through a reverse conveyance portion 10 where front and rear sides of the recording material are reversed, and a toner image is transferred and fixed to a second surface, i.e., rear surface, of the recording material, before the recording material is placed on the sheet discharge tray 7.

The control unit 30 performs control of the whole image forming apparatus 1, as described above. Further, various settings of the control unit 30 can be entered through an operation portion 4 or a display portion 5 of the image forming apparatus 1. The operation portion 4 and the display portion 5 can be a touch panel and buttons provided on the image forming apparatus 1 that can be operated manually.

Such control unit 30 includes a CPU (Central Processing Unit), a ROM (Read Only Memory), and a RAM (Random Access Memory). The CPU reads programs that correspond to the control procedure stored in the ROM and performs control of respective units. Further, work data and input data are stored in the RAM, and the CPU carries out control based on the aforementioned programs while referring to data stored in the RAM.

Fixing Unit

Figure 2:
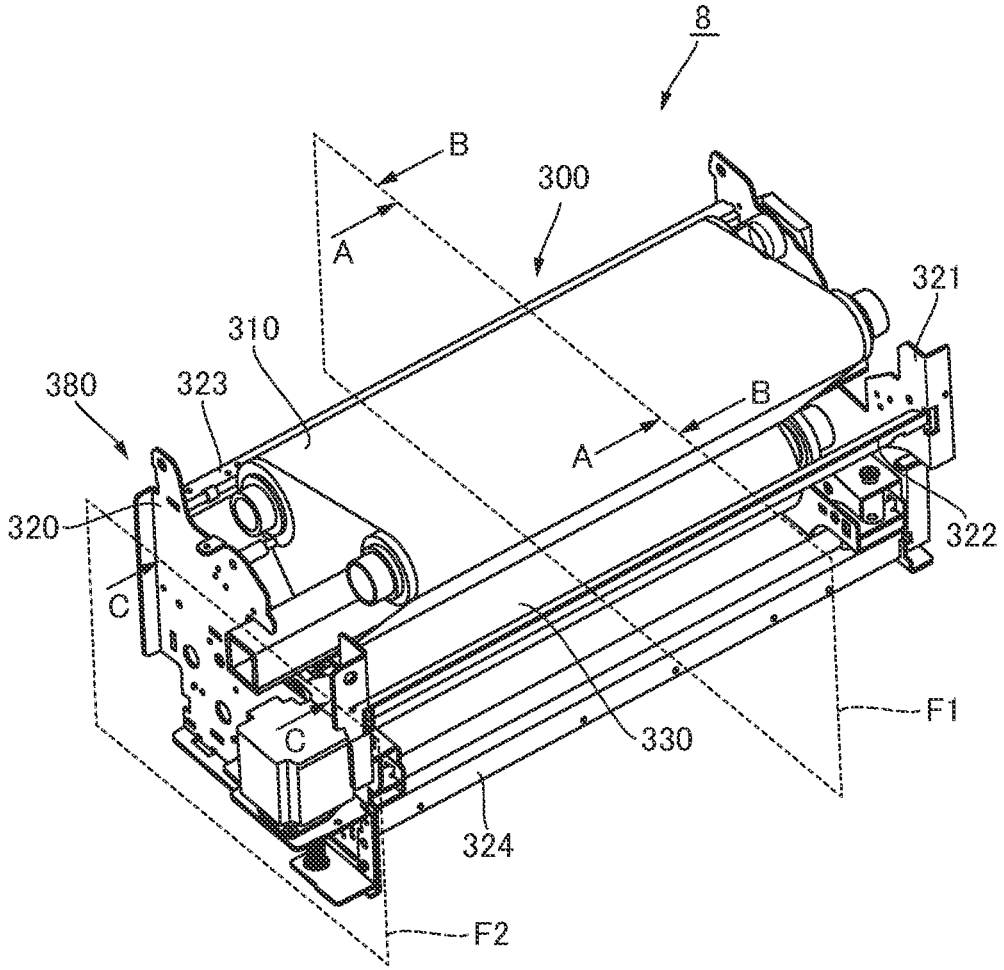
FIG. 2 is a perspective view of a fixing unit according to the embodiment.

Next, a configuration of the fixing unit 8 serving as an image heating apparatus according to the present embodiment will be described with reference to FIGS. 2 to 5. FIG. 2 is a perspective view of the fixing unit 8, wherein a lower left side of FIG. 2 is a front side and upper right side is a rear side. Now, the front side is a front side of the image forming apparatus 1 from where an operator operates the image forming apparatus 1. The rear side is a rear side of the image forming apparatus 1. In the present embodiment, the fixing unit 8 is movable with respect to a casing 3*a* (refer to FIG. 1) of the image forming apparatus 1, and by drawing out the fixing unit 8 to the front side of the casing 3*a*, the fixing belt 310 and other components described hereafter can be replaced by exposing the fixing unit 8 from the casing 3*a*. Meanwhile, the fixing unit 8 can be stored in the casing 3*a* by pressing the fixing unit 8 into the casing 3*a*.

Figure 3:
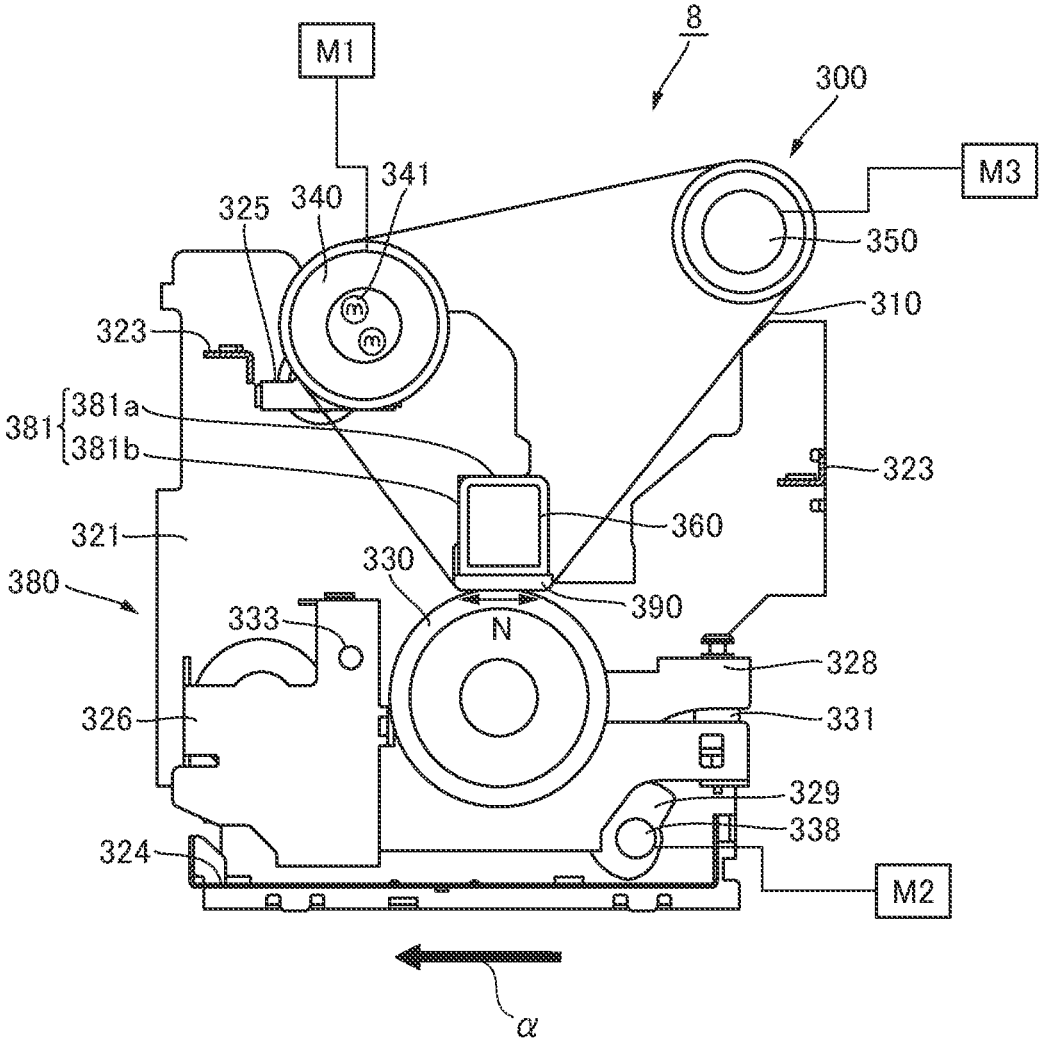
FIG. 3 is a cross-sectional view taken at A-A of FIG. 2.
Figure 4:
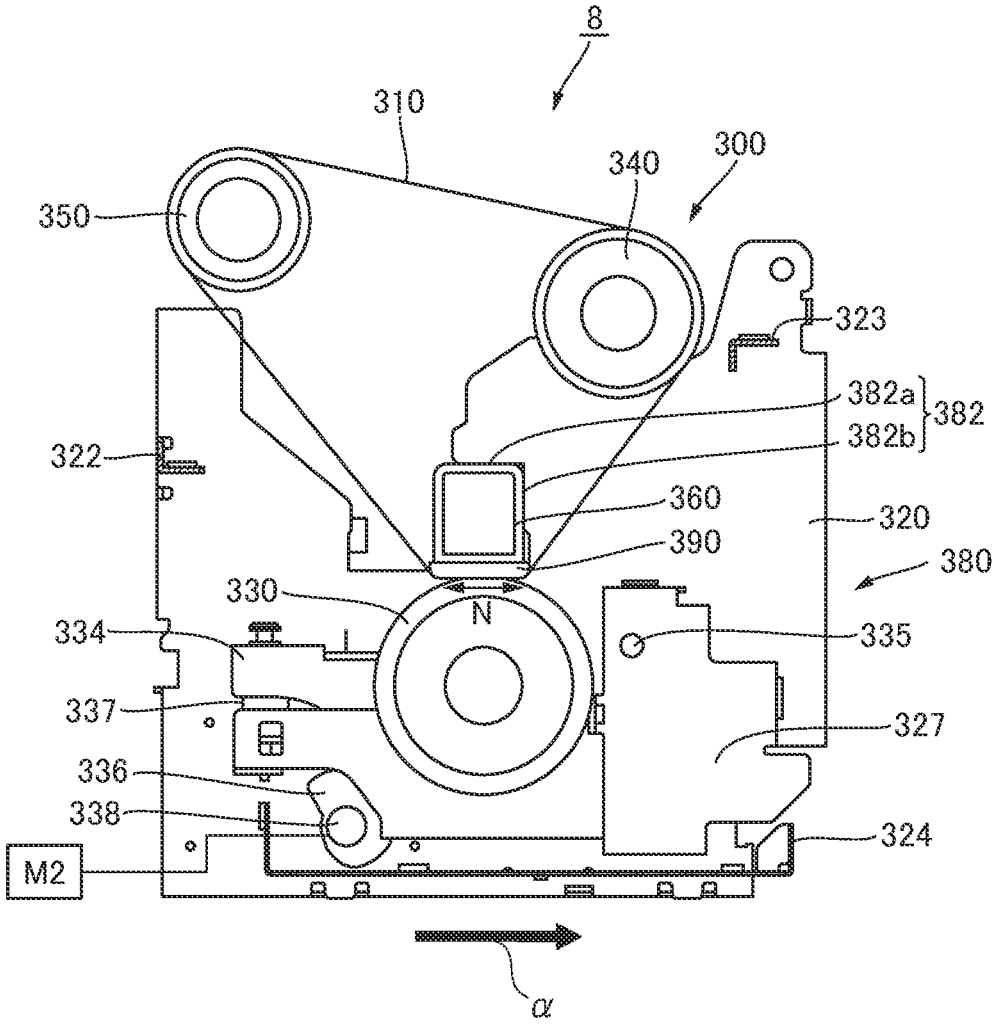
FIG. 4 is a cross-sectional view taken at B-B of FIG. 2.
Figure 5:
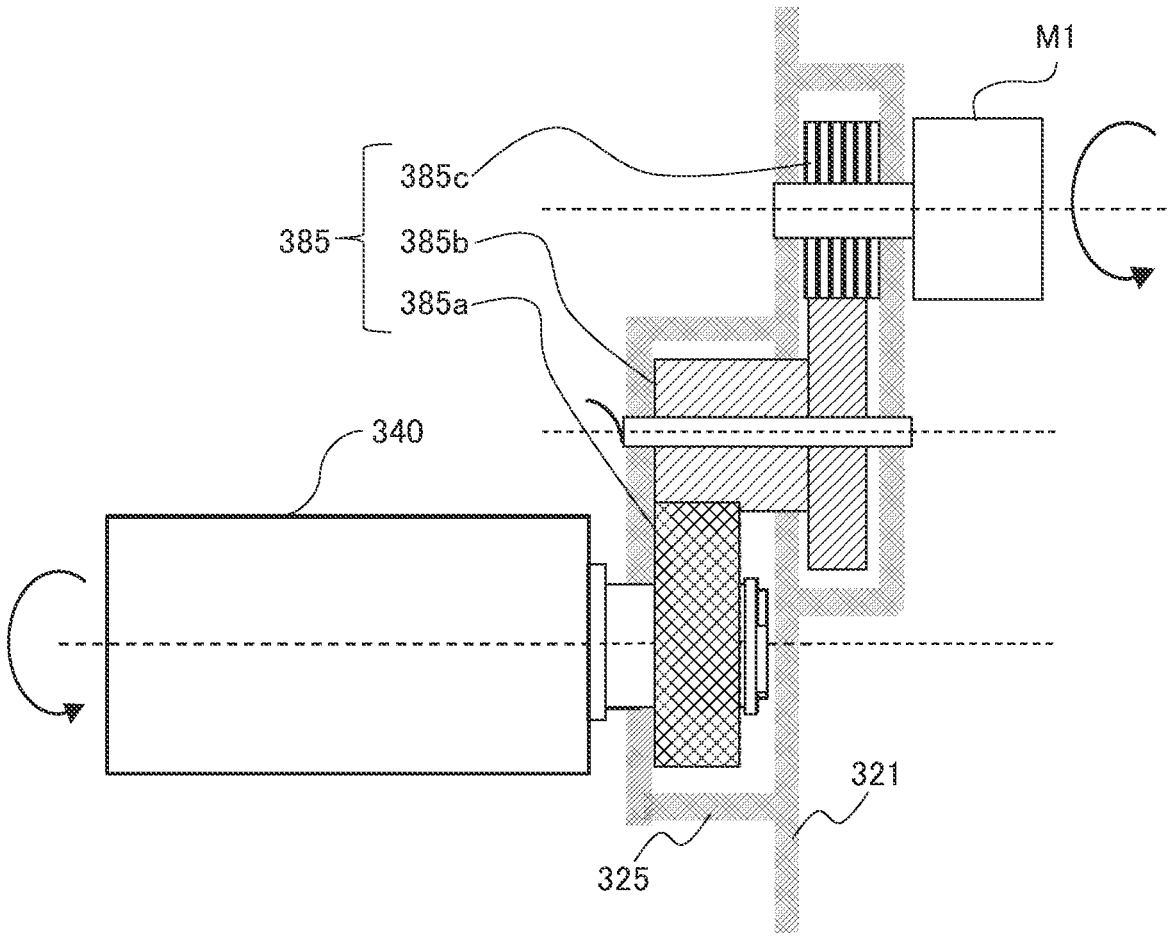
FIG. 5 is a schematic cross-sectional view of a drive transmission mechanism leading to a heating roller according to the embodiment.

FIG. 3 is a view taken from the direction of arrow A in a state where the fixing unit 8 of FIG. 2 is cut at a cut section F1. The cut section F1 is across section orthogonal to a rotational axis of the pressure roller 330 described hereafter of the fixing unit 8, and FIG. 3 is a view illustrating the cut section F1 of the fixing unit 8 from the front direction. FIG. 4 is a view taken from the direction of arrow A in a state where the fixing unit 8 of FIG. 2 is cut at the cut section F1, and it illustrates the cut section F1 of the fixing unit 8 from the rear side. FIG. 5 is a cross-sectional view illustrating a drive configuration of the heating roller 340 described later.

The fixing unit 8 according to the present embodiment adopts a belt heating-type fixing unit using an endless belt. In FIG. 3, the recording material is conveyed from right to left, as illustrated by arrow a. The fixing unit 8 includes a heating unit 300 having a fixing belt 310 that serves as an endless rotatable belt member, and a pressure roller 330 serving as a pressure rotating body that contacts the fixing belt 310 and forms a nip portion N together with the fixing belt 310.

The heating unit 300 includes the above-mentioned fixing belt 310 serving as a first rotary member, a fixing pad 390 serving as a nip portion forming member and a pad member, and a heating roller 340 and a steering roller 350 serving as stretching members.

The fixing belt 310, which is an endless belt, has thermal conductivity and heat resisting property, and is formed to have a thin cylindrical shape. In the present embodiment, the fixing belt 310 adopts a three-layer structure including a base layer, an elastic layer formed on an outer circumference of the base layer, and a release layer formed on an outer circumference of the elastic layer. The base layer is made of polyimide resin (PI) and has a thickness of 60 μm, the elastic layer is made of silicone rubber and has a thickness of 300 μm, and the release layer is made of PFA (tetrafluoroethylene-perfluoro alkoxy ethylene copolymer resin) as fluororesin and has a thickness of 30 μm. This fixing belt 310 is stretched across the fixing pad 390, the heating roller 340 and the steering roller 350.

The fixing pad 390 serving as a nip portion forming member is arranged on an inner side of the fixing belt 310 opposing the pressing roller 330 with the fixing belt 310 interposed therebetween and forms the nip portion N between the fixing belt 310 and the pressing roller 330 for nipping and conveying the recording material. In the present embodiment, the fixing pad 390 is an approximately plate-shaped member having a long length in a width direction of the fixing belt 310, which is a longitudinal direction intersecting a direction of rotation of the fixing belt 310, or a rotational axis direction of the heating roller 340. The nip portion N having a predetermined width in a conveyance direction of the recording material is formed by the fixing pad 390 being pressed against the pressing roller 330 and nipping the fixing belt 310. The material of the fixing pad 390 is LCP (liquid crystal polymer).

At least a portion of the fixing pad 390 forming the nip portion N has a planar shape. That is, the portion of the fixing pad 390 that contacts an inner circumferential surface of the fixing belt 310 through a lubricating sheet not shown is formed in an approximately planar shape, and therefore, the shape of the nip portion is approximately flat. According to such configuration, especially when fixing a toner image on an envelope serving as the recording material, it becomes possible to suppress occurrence of wrinkles and image deviation on the envelope.

The fixing pad 390 is supported by a stay 360 serving as a support member arranged on the inner side of the fixing belt 310. That is, the stay 360 is arranged on an opposite side from the pressing roller 330 with respect to the fixing pad 390 and supports the fixing pad 390. The stay 360 is a reinforcement member having rigidness and a long length along the longitudinal direction of the fixing belt 310, which contacts the fixing pad 390 and reinforces the fixing pad 390 from the back. That is, in a state where the fixing pad 390 is pressed by the pressure roller 330, the stay 360 provides sufficient rigidity to the fixing pad 390 to ensure pressing force to be applied at the nip portion N.

The stay 360 is made of metal such as stainless steel, and has an approximately rectangular cross section, i.e., transverse section, orthogonal to the longitudinal direction of the stay 360 intersecting the direction of rotation of the fixing belt 310. The stay 360 has both ends thereof supported by a fixing frame, i.e., frame or casing, 380 of the fixing unit 8. As illustrated in FIG. 2, the fixing frame 380 is composed of a front side plate 320, a rear side plate 321, a right stay 322, a left stay 323, and a bottom plate 324.

A lubricating sheet not shown is interposed between the fixing pad 390 and the fixing belt 310. In the present embodiment, a PI (polyimide) sheet coated with PTFE (polytetrafluoroethylene) and having a thickness of 100 μm is used as the lubricating sheet. The PI sheet has 100-μm projections formed at 1-mm intervals, and sliding friction thereof is lowered by reducing the contact area with the fixing belt 310.

Lubricant for improving slidability is applied in advance to a surface of the lubricating sheet that is in contact with the fixing belt 310. In the present embodiment, oil is used as lubricant. Silicone oil is suitably used as lubricant from the viewpoint of heat resisting property, and silicone oil having various viscosities are used according to conditions of use.

As illustrated in FIGS. 3 and 4, the heating roller 340 is arranged on the inner side of the fixing belt 310, stretching the fixing belt 310 together with the fixing pad 390 and the steering roller 350. As described above, lubricant is applied on the inner circumferential surface of the fixing belt 310, so that the fixing belt 310 is stretched by the heating roller 340 with the lubricant applied therebetween. The heating roller 340 is arranged downstream of the fixing pad 390 and upstream of the steering roller 350 in the direction of rotation of the fixing belt 310. Thereby, the fixing belt 310 that has passed through the nip portion N is directly drawn by the driving force of the heating roller 340 without having a stretching roller interposed therebetween.

The heating roller 340 is made of metal such as aluminum and stainless steel and formed in a cylindrical shape, and a plurality of halogen heaters 341 serving as a plurality of heaters for heating the fixing belt 310 are arranged on the inner side thereof (FIG. 3). The heating roller 340 is heated to a predetermined temperature by the halogen heaters 341.

In the present embodiment, the heating roller 340 is formed of a stainless-steel pipe having a thickness of 1 mm, and on the inner side of the heating roller 340 are arranged the plurality of halogen heaters 341. It is preferable to have a plurality of halogen heaters from the viewpoint of temperature distribution control in the longitudinal direction, that is, rotational axis direction, of the heating roller 340. The multiple halogen heaters 341 have mutually different light distributions in the longitudinal direction, and lighting ratios thereof are controlled according to the size of the recording material. The heater is not limited to a halogen heater, and other types of heaters, such as a carbon heater, capable of heating the heating roller 340 can be used. The fixing belt 310 is heated by the heating roller 340 which is heated by the halogen heaters 341 and controlled to a predetermined target temperature according to the type of recording material being used based on temperature detected by a thermistor not shown.

The heating roller 340 is supported rotatably on the fixing frame 380. As illustrated in FIG. 5, the heating roller 340 has a gear 385*a* fixed to one end portion, i.e., rear end portion, in a rotational axis direction, which is connected via an idler gear 385*b* and a motor gear 385*c* to a motor M1 serving as a heating roller driving source and driven to rotate. The idler gear 385*b* is rotatably supported on a heating roller drive support plate 325 fixed to the rear side plate 321, and rotational driving force is transmitted to the heating roller 340 by meshing with the motor gear 385*c* and the gear 385*a* The gears 385*a*. 385*b* and 385*c* constitute a gear train 385 serving as a drive transmission mechanism from the motor M1 to the heating roller 340.

As described, the heating roller 340 is connected to the motor M1 via the gear train 385 and driven to rotate. Driving force is applied to the fixing belt 310 by the rotation of the heating roller 340. The drive transmission mechanism from the motor can be a mechanism other than gears, such as a pully and a belt, or a mechanism for pressing a roller driven by a motor from an outer side.

The steering roller 350 is arranged on an inner side of the fixing belt 310 to stretch the fixing belt 310 together with the fixing pad 390 and the heating roller 340 and driven to rotate along the rotation of the fixing belt 310. The steering roller 350 controls a position, i.e., deviation position, of the fixing belt 310 in the rotational axis direction, i.e., longitudinal direction, of the heating roller 340 by tilting with respect to the rotational axis direction of the heating roller 340. That is, the steering roller 350 has a pivot axis at a center in the rotational axis direction, i.e., longitudinal direction, of the steering roller 350, and tilts with respect to the longitudinal direction of the heating roller 340 by swinging about the pivot axis. Thereby, difference in tension is generated between one side and the other side of the fixing belt 310 in the longitudinal direction, and the fixing belt 310 is moved in the longitudinal direction.

The steering roller 350 can be swung by a driving source such as a motor or swung through automatic aligning. The pivot axis can be set at a center in the longitudinal direction as according to the embodiment or at a longitudinal end portion. In the present embodiment, a motor M3 for tilting the steering roller 350 is provided.

In the present embodiment, the steering roller 350 is urged by a spring supported on a frame of the heating unit 300 and also serves as a tension roller that applies predetermined tension to the fixing belt 310. As described, by applying tension to the fixing belt 310 by the steering roller 350, the fixing belt 310 is moved to rotate along the fixing pad 390.

The pressure roller 330 serving as the second rotary member is a roller having an elastic layer formed on an outer circumference of a shaft and a releasing layer formed on an outer circumference of the elastic layer. The shaft is made of stainless steel, the elastic layer is made of conductive silicone rubber having a thickness of 5 mm, and the releasing layer is made of PFA (tetrafluoro-ethylene-perfluoro alkoxy ethylene copolymer resin) as fluororesin and having a thickness of 50 μm.

The fixing frame 380 includes the front side plate 320 and the rear side plate 321 as described above, and as illustrated in FIGS. 3 and 4, the front side plate 320 and the rear side plate 321 include heating unit positioning portions 381 and 382. The heating unit positioning portions 381 and 382 include pressure direction regulating surfaces 381*a* and 382*a* facing the pressure roller 330 and conveyance direction regulating surfaces 381*b* and 382*b* that are abutting surfaces of the heating unit 300 in the inserting direction.

The heating unit 300 is positioned on the fixing frame 380 by having the stay 360 inserted to the heating unit positioning portions 381 and 382 and the stay 360 being fixed to the heating unit positioning portions 381 and 382 by a fixing unit not shown. In this state, the stay 360 is fixed in such a state that movement is regulated by the pressure direction regulating surfaces 381*a* and 382*a* and the conveyance direction regulating surfaces 381*b* and 382*b*.

Further, a pressure arm support plate 326 (FIG. 3) is fixed to the rear side plate 321 and a pressure arm support plate 327 (FIG. 4) is fixed to the front side plate 320 by welding. The pressure arm support plate 326 is a component that rotatably supports a pressure arm 328, and the pressure arm 328 is a component that rotatably supports the pressure roller 330. Similarly, the pressure arm support plate 327 is a component that rotatably supports a pressure arm 334, and the pressure arm 334 is a component that rotatably supports the pressure roller 330. That is, the pressure roller 330 has both end portions supported rotatably by the pressure arms 328 and 334 arranged on the front and rear sides.

The front and rear pressure arms 328 and 334 are connected movably about front and rear rotation shafts 333 and 335 to a motor M2 serving as a driving source for applying pressure, and lifted by front and rear cams, i.e., pressure cams, 329 and 336 for applying pressure. The front and rear cams 329 and 336 are connected to a cam shaft 338 serving as a rotation shaft. Specifically, the cams 329 and 336 are fixed to end portions of the cam shaft 338, and they are rotatable at the same phases. By having the front and rear pressure arms 328 and 334 lifted by the cams 329 and 336, the pressure roller 330 apples pressure to the fixing pad 390 via the fixing belt 310, and a predetermined pressing force is applied by pressure springs 331 and 337. That is, the pressure arms 328 and 334 serving as a displacement mechanism abut against the cams 329 and 336 and displace the pressure roller 330 with respect to the fixing belt 310 along with the rotation of the cams 329 and 336.

As described, the pressure roller 330 has both end portions supported by the front and rear pressure arms 328 and 334, and the pressure arms 328 and 334 are lifted by the cams 329 and 336 so that a nip portion Nis formed between the fixing belt 310 and the pressure roller 330. A recording material P bearing a toner image is nipped and conveyed by the nip portion N during which the toner image is heated, and the toner image is fixed to the recording material P.

Meanwhile, during a period when an image fixing process to the recording material P is not performed, the pressure arms 328 and 334 are moved to a separating direction by the cams 329 and 336 connected to the motor M2, so that the fixing belt 310 and the pressure roller 330 are separated and the nip is released for standby. That is, the cams 329 and 336 can be rotated so as to abut the pressure roller 330 against or separated the pressure roller 330 from the fixing belt 310.

Drive Transmission Device

Next, a pressure driving device 391 serving as a changing mechanism including a drive transmission device 400 for transmitting drive from the motor M2 serving as a driving source to the front and rear cams 329 and 336 (refer to FIGS. 3 and 4) will be described with reference to FIG. 6. The pressure driving device 391 includes a pressure drive support plate 389, the motor M2, and the drive transmission device 400, which are formed as a unit and fixed to the front side plate 320 of the fixing unit 8. Therefore, when the fixing unit 8 is to be removed from the image forming apparatus, the motor M2 and the drive transmission device 400 are removed integrally with the fixing belt 310 and the pressure roller 330. Meanwhile, the motor M1 and the motor M3 are attached to the rear side plate 321. As a result, according to the present embodiment, when the fixing unit 8 is removed from the image forming apparatus, the motors M1 to M3 and the drive transmission device 400 are removed integrally with the fixing belt 310 and the pressure roller 330.

The drive transmission device 400 includes a worm gear 401, a pair of bearings 399, a pressure drive gear 395 serving as a first drive transmission member, and a gear 394 serving as a second drive transmission member. The worm gear 401 is composed of a worm wheel 392 and a worm 393. The worm wheel 392 is fixed to one end portion of the cam shaft 338 serving as a rotation shaft of the cams 329 and 336. The worm 393 is provided on a rotation shaft 393*a* that is driven to rotate by the motor M2 and meshes with the worm wheel 392. In the present embodiment, the worm 393 is made of metal, and specifically, it is made of stainless steel. It is preferable to form the worm wheel 392 of the same metal material as the worm 393. The pressure drive gear 395 and the gear 394 should also preferably be made of metal. The pair of bearings 399 support the rotation shaft 393*a* at ends of the worm 393 with respect to the rotational axis direction of the worm 393. That is, the pair of bearings 399 is arranged one on each side of the worm 393 and rotatably support the rotation shaft 393*a*.

The pressure drive gear 395 is arranged on a drive shaft 395*a* of the motor M2. That is, the pressure drive gear 395 is fixed to the drive shaft 395*a* and rotates together with the drive shaft 395*a*. The gear 394 is arranged on the rotation shaft 393*a* at one end side of the worm 393 with respect to the rotational axis direction of the worm 393, to which drive is transmitted from the pressure drive gear 395. Specifically, the gear 394 is fixed to an end portion of the rotation shaft 393*a* at one end further toward the edge than one of the bearings 399 of the pair of bearings 399, and the gear 394 is driven by the motor M2 to rotate together with the rotation shaft 393*a* and the worm 393 by meshing with the pressure drive gear 395. The pressure drive gear 395 and the gear 394 are spur gears that are meshed with each other.

According to the present embodiment adopting the above-mentioned configuration, the cams 329 and 336 are driven to rotate by the motor M2. That is, in a state where the drive shaft 395*a* and the pressure drive gear 395 are rotated by the motor M2, the gear 394 meshing with the pressure drive gear 395 is rotated, and the worm 393 is rotated together with the gear 394. Further, in a state where the worm wheel 392 meshing with the worm 393 is rotated, the cams 329 and 336 are rotated via the cam shaft 338 to which the worm wheel 392 is fixed. Thereby, the positions of the pressure arms 328 and 334 (FIGS. 3 and 4) are changed, and as described above, the fixing belt 310 and the pressure roller 330 are mutually abutted against or separated from each other. The arrangement will now be explained. The motor M2 is arranged above the worm 393 in the vertical direction. According to this configuration, the motor M2 is overlapped with the worm 393 when viewed from above. Further, the motor M2 is arranged above the worm wheel 392 in the vertical direction.

Method for Changing Pressing Force

In the present embodiment, the fixing belt 310 and the pressure roller 330 are abutted against or separated from each other by rotating the cams 329 and 336 as described above. In addition to having the fixing belt 310 and the pressure roller 330 abut against or separate from each other, pressing force by the pressure roller 330 can be changed so as to change the nip pressure between the fixing belt 310 and the pressure roller 330. That is, the position of the pressure roller 330 with respect to the fixing belt 310 is changed so as to change between application of pressing force and releasing of pressing force at the nip portion. Along with the recent increase in variety of media that can be used in the image forming apparatus, the fixing unit is required to perform optimal fixing processes to the various types of recording materials ranging from normal paper to special paper such as envelopes. Therefore, according to the present embodiment, the pressing force, i.e., nip pressure, applied to the nip portion is changed to cope with various types of media.

Figure 7A:
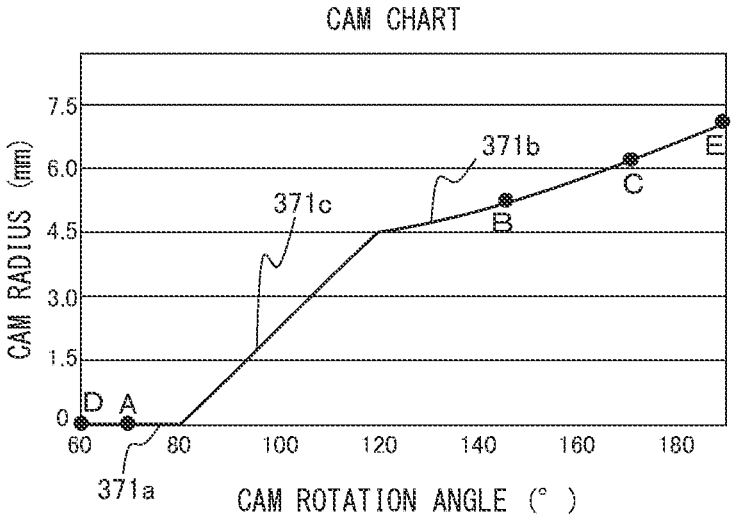
FIG. 7A is graph illustrating a relationship between rotation angle of a cam and cam radius.
Figure 7B:
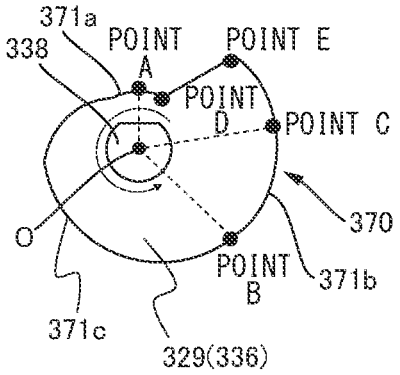
FIG. 7B is a schematic diagram of a cam showing respective points of FIG. 7A.
Figure 7C:
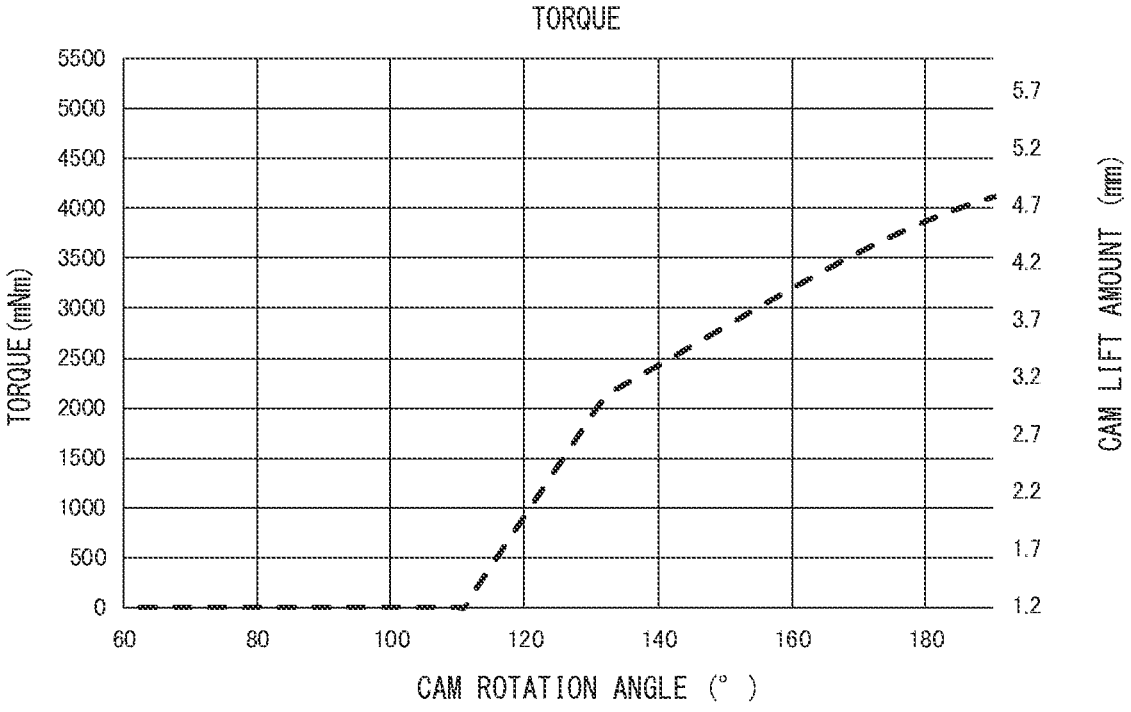
FIG. 7C is a graph illustrating a relationship between rotation angle of the cam and shaft torque of the cam.
Figure 8:
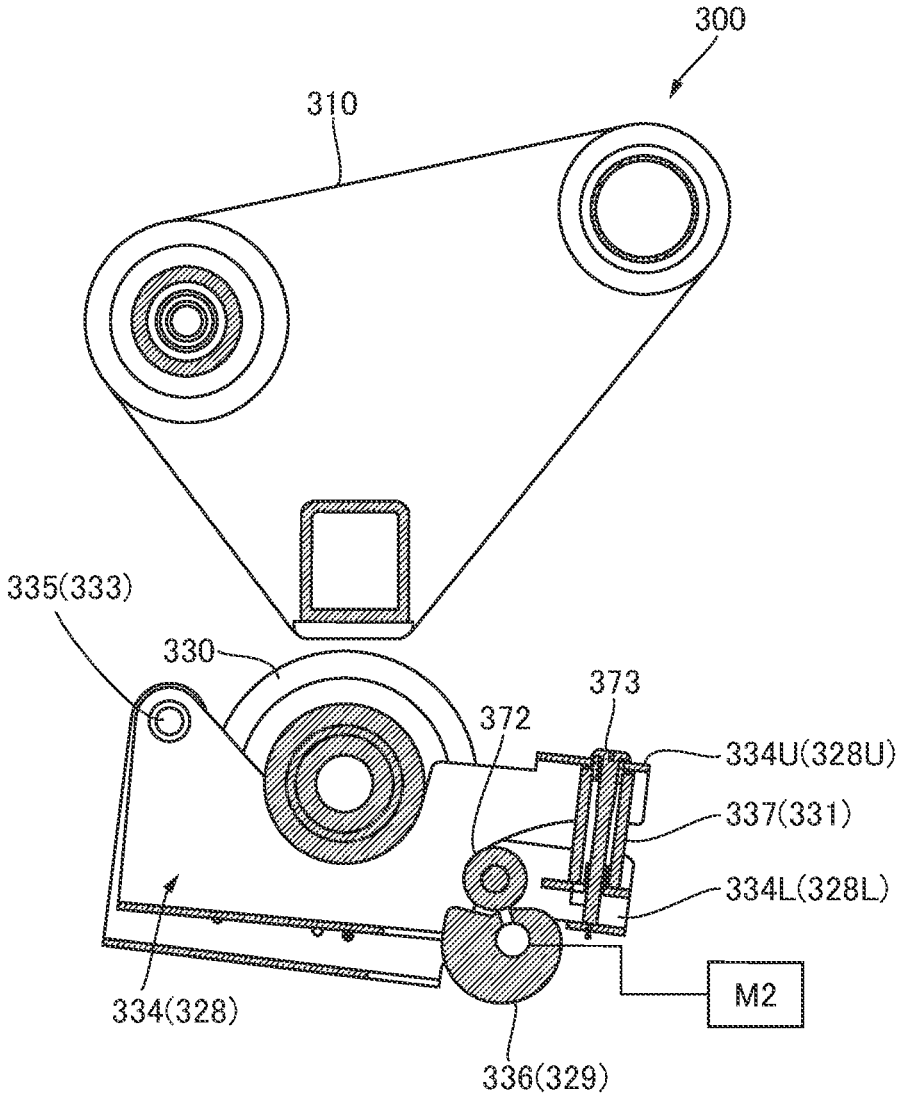
FIG. 8 is a cross-sectional view taken at C-C of FIG. 2 in a separated state.
Figure 9:
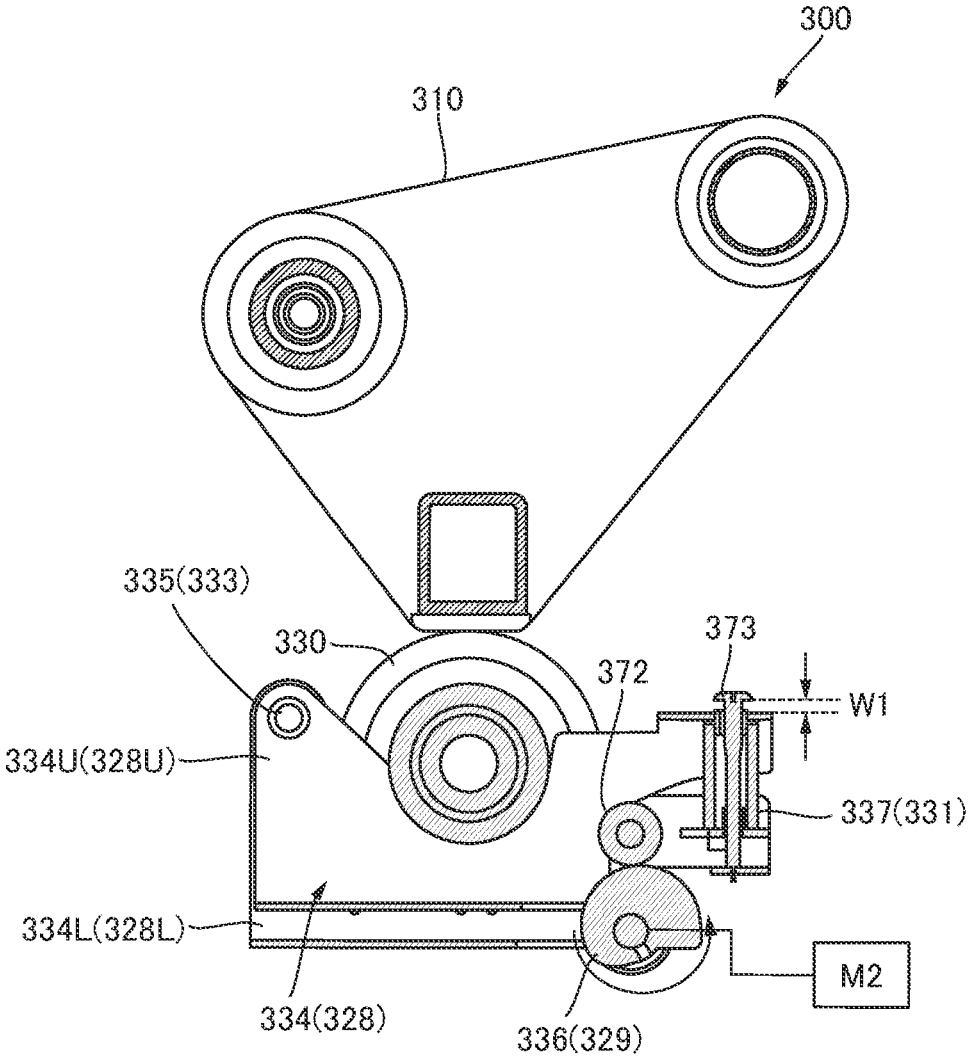
FIG. 9 is a cross-sectional view taken at C-C of FIG. 2 in a state where a pressure corresponding to an envelope is applied.
Figure 10:
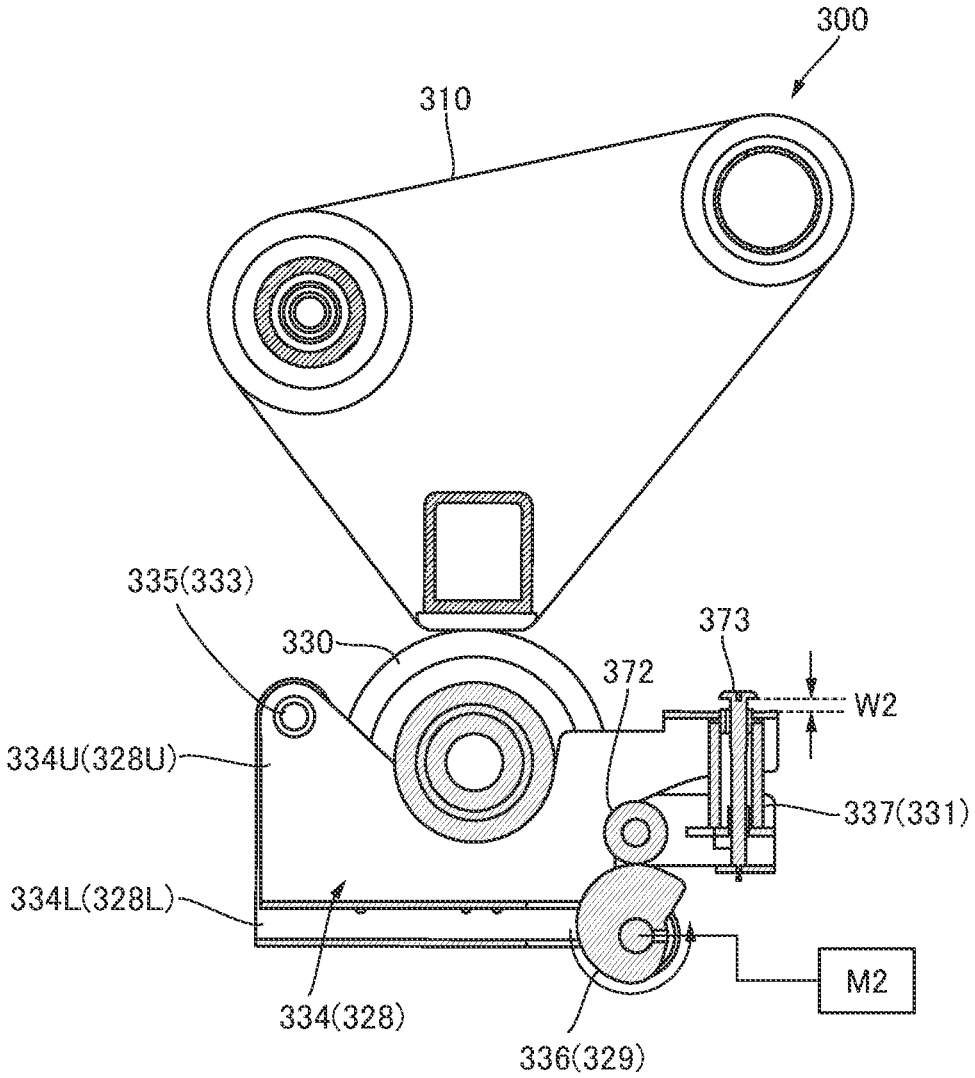
FIG. 10 is a cross-sectional view taken at C-C of FIG. 2 in a state where a pressure corresponding to recording materials other than envelopes is applied.

Such a method for changing the pressing force will be described with reference to FIGS. 7A to 10. FIG. 7A is a cam chart of the front and rear cams 329 and 336, FIG. 7B is a schematic view of the corresponding cams 329 and 336, and FIG. 7C illustrates a shaft torque of the cams 329 and 336. FIGS. 8 to 10 illustrate across-sectional view of the fixing unit 8 of FIG. 2 cut at a cut section F2 and viewed in the arrow C direction. The cut section F1 is a cross section orthogonal to the rotational axis of the pressure roller 330 of the fixing unit 8, and FIGS. 8 to 10 are views illustrating the cut section F2 of the fixing unit 8 from the front side. FIGS. 8 to 10 illustrate pressure states by transition of the front and rear cams 329 and 336.

The cams 329 and 336 are designed to enable the fixing belt 310 and the pressure roller 330 to be abutted against and separated from each other, and to change the pressing force applied to the nip portion N in multiple steps in a state where the fixing belt 310 and the pressure roller 330 are abutted against each other. At first, FIG. 7A is a cam chart illustrating a relationship between cam radius and rotation angle, i.e., phase, of the cams 329 and 336 in a state where the front and rear cams 329 and 336 are rotated from point D to point E in a counterclockwise direction of FIG. 7B. In FIG. 7A, point D is set as reference, that is, as 0 mm to illustrate the cam radius.

A cam surface 370 of the cams 329 and 336 is composed of a flat cam surface 371*a* corresponding to a separated phase range including point A where the pressure roller 330 and the fixing belt 310 are separated, and a gradient cam surface 371*b* corresponding to a pressure contact phase range of the pressure roller 330 forming the nip portion N. The cam surface 370 is a surface that is in contact with a cam follower 372 (FIGS. 8 to 10) described later. The flat cam surface 371*a* is a flat surface that is approximately orthogonal to the direction of reaction force from the cam follower 372 in a state where the cam surface is in contact with the cam follower 372.

The gradient cam surface 371*b* is a surface within whose range of phase the pressure roller 330 abuts against the fixing belt 310, and the surface changes the pressing force applied by the pressure roller 330. Regarding a counterclockwise direction of FIG. 7B, a transition cam surface 371*c* for moving the pressure roller 330 from a position where the pressure roller 330 is separated from the fixing belt 310 to a position abutting against the fixing belt 310 is formed between the flat cam surface 371*a* and the gradient cam surface 371*b*.

The gradient cam surface 371*b* and the transition cam surface 371*c* are each formed so that the distance, i.e., cam radius, from a center of rotation O of the cams 329 and 336 is gradually increased in the counterclockwise direction of FIG. 7B. An increase rate of the cam radius is smaller for the gradient cam surface 371*b* than the transition cam surface 371*c*.

Point B of the gradient cam surface 371*b* is a point where pressing force for performing a fixing processing of envelopes is applied. Point C of the gradient cam surface 371*b* is a point where pressing force for performing fixing processing of recording materials other than envelopes is applied. Therefore, in the present embodiment, the cams 329 and 336 can change the pressing force applied to the nip portion to two levels. However, it is also possible to design the cams to enable the pressing force to be changed to three or more levels. For example, as for the recording material having a high grammage such as thick paper, a pressing force greater than the pressing force applied at point C described above can be set in addition.

FIG. 7C illustrates a shaft torque of the cams 329 and 336 in a state where pressing force is applied to the nip portion N by the gradient cam surface 371*b* that includes points B and C illustrated in FIGS. 7A and 7B. Further, in FIG. 7C, an amount of movement of the pressure arms 328 and 334 by the cams 329 and 336, i.e., cam lift amount, is also illustrated. Based on FIG. 7C, it can be recognized that the shaft torque increases as the rotation angle of the cams 329 and 336 increases, that is, as the cam radius increases, in the gradient cam surface 371*b*.

FIG. 8 illustrates a separated state where the pressure roller 330 is separated from the fixing belt 310. Since FIG. 8 is a view showing the cut section F of FIG. 2 from the arrow C direction, the pressure arm 334 and the cam 336 on the front side are illustrated. However, the pressure arm 328 and the cam 329 on the rear side adopt the same configuration, so that in the following description, the front and rear pressure arms 328 and 334 and cams 329 and 336 are described, similar to the aforementioned description. The same applies for FIGS. 9 and 10.

As illustrated in FIG. 8, the front and rear pressure arms 328 and 334 (refer to FIGS. 3 and 4) are composed of upper arm portions 328U and 334U, lower arm portions 328L and 334L, the cam follower 372, a pressure screw 373, and the pressure springs 331 and 337. The upper arm portions 328U and 334U and the lower arm portions 328L and 334L are respectively relatively supported pivotably about the front and rear rotation shafts 333 and 335 at base end portions.

The pressure springs 331 and 337 are respectively arranged m an elastically compressed state between tip portions of the upper arm portions 328U and 334U and the lower arm portions 328L and 334L The pressure springs 331 and 337 urge the tip portions of the upper arm portions 328U and 334U and the lower arm portions 328L and 334L in a direction widening a distance therebetween. Further, relative movement of the tip portions of the upper arm portions 328U and 334U and the lower arm portions 328L and 334L is regulated by the pressure screw 373 so as not to be widened beyond a predetermined distance. Relative movement of the tip portions of the upper arm portions 328U and 334U and the lower arm portions 328L and 334L in a narrowing direction is permitted. The cam follower 372 is supported rotatably by the lower arm portions 328L and 334L so as to be in contact with the front and rear cams 329 and 336.

At first, while the fixing processing of the recording material is not performed, the fixing belt 310 and the pressure roller 330 are separated, and the nip is released in a standby state. In this state, as illustrated in FIG. 8, the cam follower 372 is abutted against the front and rear cams 329 and 336 at point A illustrated in FIGS. 7A and 7B. In this state, the distance between tip portions of the upper arm portions 328U and 334U and the lower arm portions 328L and 334L is regulated by the pressure screw 373.

Next, in a state where the fixing processing is performed to envelopes, the motor M2 is driven to rotate the cams 329 and 336 in the arrow direction as illustrated in FIG. 9. In a state where the cams 329 and 336 are rotated, the lower arm portions 328L and 334L are pushed up via the cam follower 372, and further, the upper arm portions 328U and 334U are pushed up via the pressure springs 331 and 337. The pressure roller 330 supported by the upper arm portions 328U and 334U is abutted against the fixing belt 310. In a state where the cams 329 and 336 are rotated until they are abutted against the cam follower 372 at point B, a nip portion that applies a pressing force for envelopes is formed between the fixing belt 310 and the pressure roller 330.

In this state, in contrast to the regulation of movement of the upper arm portions 328U and 334U by the pressure roller 330 abutting against the fixing belt 310, the lower arm portions 328L and 334L are relatively moved upward, by which the pressure springs 331 and 337 are compressed for W1. Thereby, the upper arm portions 328U and 334U are urged by the pressure springs 331 and 337, and a pressing force for envelopes, such a pressing force of 100) N, is applied to the nip portion N.

Finally, when performing the fixing processing to a recording material other than envelopes, the motor M2 is driven to rotate the cams 329 and 336 from the state of FIG. 9 further to the arrow direction, as illustrated in FIG. 10. Thereby, the lower arm portions 328L and 334L are pushed up further, and the pressure springs 331 and 337 are compressed further. In a state where the cams 329 and 336 are rotated to be abutted against the cam follower 372 at point C, an amount of compression of the pressure springs 331 and 337 will be W2 which is greater than W1 which is the amount of compression for envelopes. Thereby, the upper arm portions 328U and 334U are urged by the pressure springs 331 and 337, and a pressing force for recording materials other than envelopes, such as a pressing force of 1500 N, is applied to the nip portion N. Of course, the pressing force for a recording material other than envelopes is greater than the pressing force for envelopes.

As described, in a state where the fixing processing is performed to the recording material, the cams 329 and 336 are abutted against the cam follower 372 at points B and C. As illustrated in FIGS. 7A to 7C, the cam shaft 338 receives reaction force as shaft torque from the cams 329 and 336 at points Band C. The cam shaft 338 is driven by the motor M2, so that the reaction force may act on the motor M2 according to the configuration of the drive transmission device from the motor M2 to the cam shaft 338.

According to the present embodiment, the worm gear 401 is adopted in the drive transmission path from the motor M2 to the cam shaft 338. By adopting the worm gear 401, a large reduction ratio can be achieved without using many gears. Further, the worm gear 401 has a so-called self-locking function in which driving force is not easily transmitted from the worm wheel 392 to the worm 393. As described, the worm wheel 392 is fixed to one end portion of the cam shaft 338 and the worm wheel 392 is connected with the worm 393 to transmit drive. Therefore, according to the present embodiment, the reaction force from the cams 329 and 336 is locked by the self-locking function of the worm gear 401 itself, so that reaction force is prevented from being transmitted to the motor M2.

Thereby, even if the cam is stopped at an arbitrary position on the gradient cam surface 371*b* that includes points B and C of the cams 329 and 336 to change the pressing force, reaction force is prevented from being transmitted to the motor M2 through the drive transmission device 400 while enabling to retain the cam phase. Thus, there is no need to supply a driving force for retaining the cam phase to the motor M2, and the pressing force of the nip portion N can be changed in an energy-saving manner. In other words, pressing force can be adjusted continuously according to the various types of recording material including envelopes in an energy-saving manner.

It may be possible to prevent the reaction force of the cam shaft 338 from being transmitted to the motor M2 by providing a clutch to the drive transmission path, but according to the present embodiment, there is no need to provide such a clutch. Therefore, the present embodiment enables to suppress the transmission of the reaction force of the cams 329 and 336 to the motor M2 while preventing increase in size and costs.

Meanwhile, a load, i.e., thrust force, in a rotational axis direction acts on the worm 393 by the reaction force from the cams 329 and 336. This arrangement will be described with reference to a comparative example 1 illustrated in FIG. 11. In comparison to the configuration of the present embodiment illustrated in FIG. 6, the comparative example 1 adopts a configuration in which the worm 393 is provided on a drive shaft 393*b* of the motor M2 and in which both sides of the worm 393 are not supported by bearings.

Figure 11:
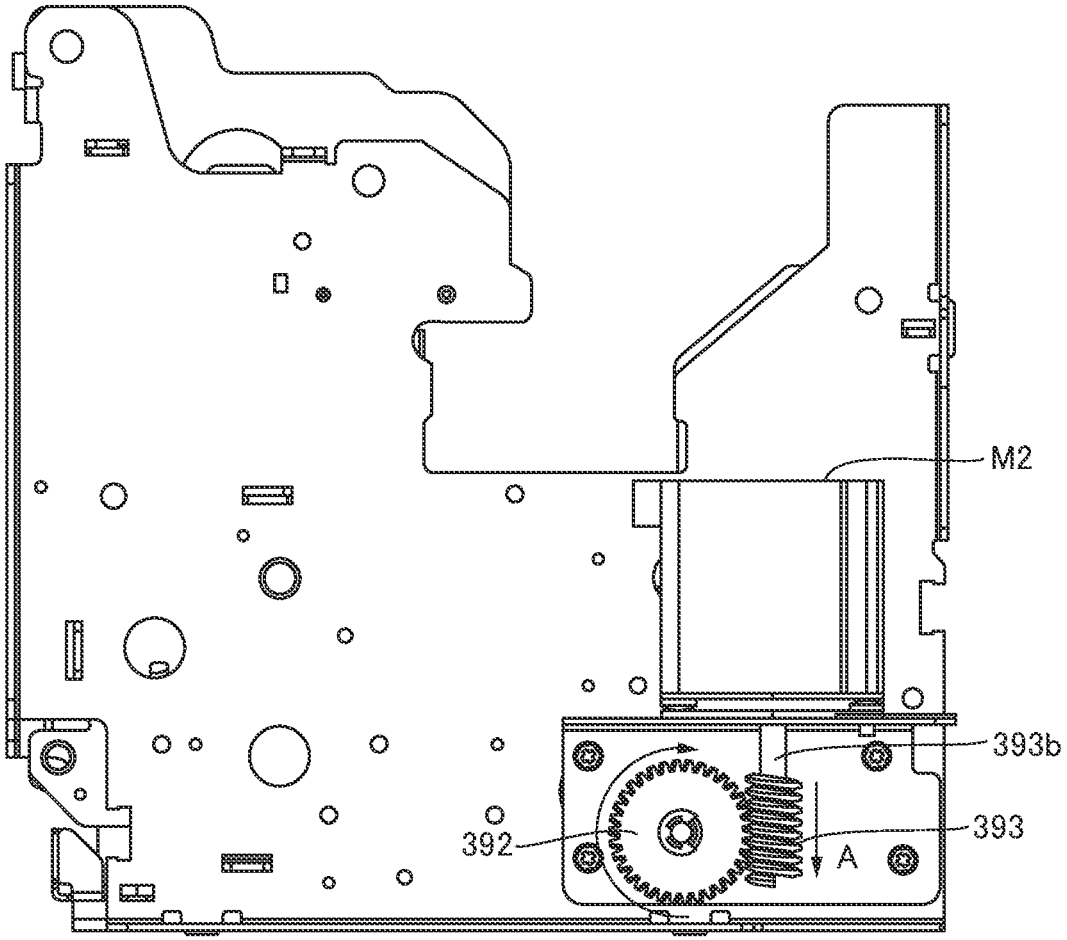
FIG. 11 is a view similar to FIG. 6 of a fixing unit according to comparative example 1.

As illustrated in FIG. 11, if the worm 393 is arranged on the drive shaft 393*b* of the motor M2, the drive shaft 393*b* will receive a thrust force in direction A by the reaction force from the cam. Then, the load applied to the internal components of the motor M2 is increased, and the durability of the motor M2 may be deteriorated.

Figure 6:
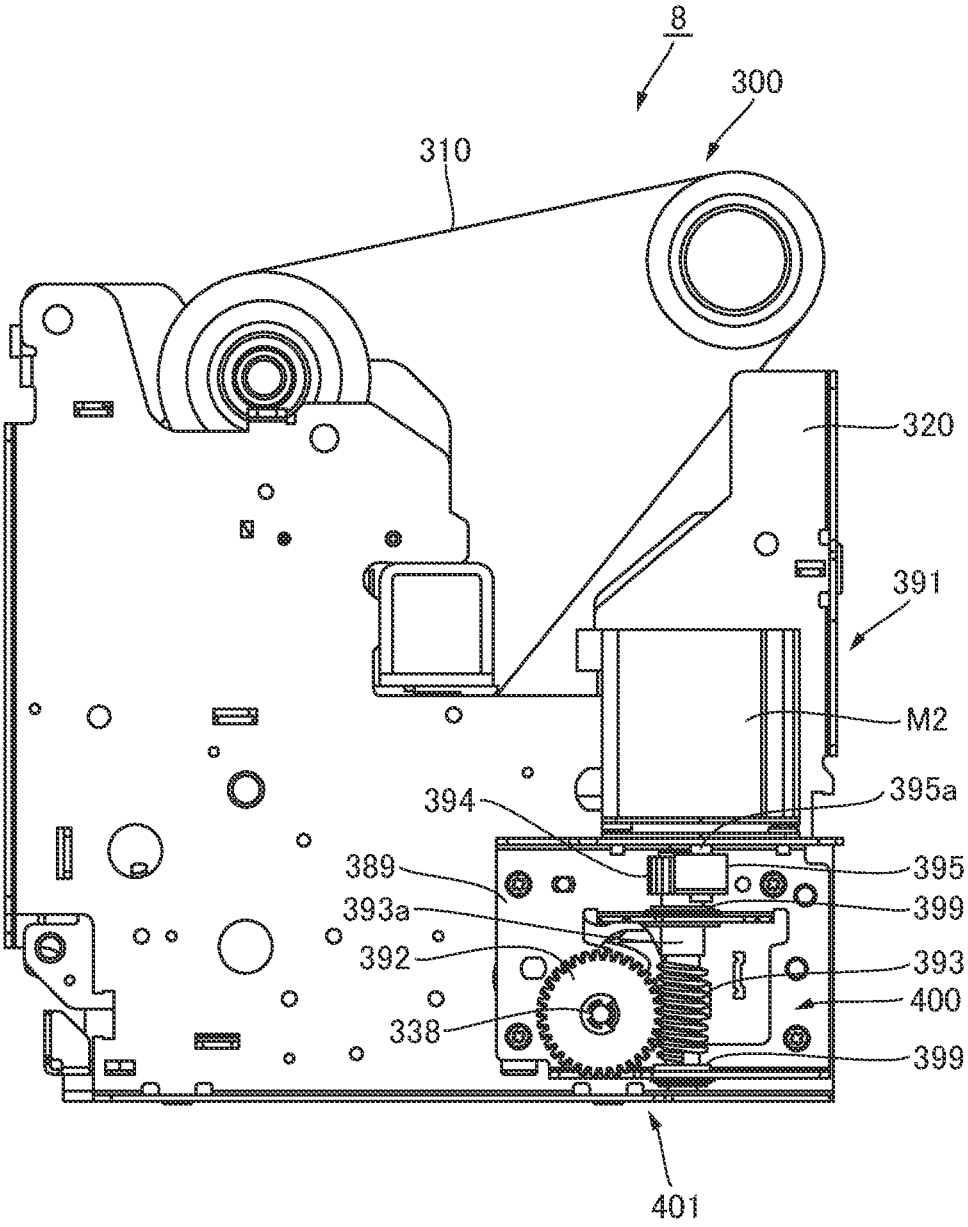
FIG. 6 is a front view of the fixing unit according to the embodiment with the drive transmission device exposed.

However, according to the present embodiment, as illustrated in FIG. 6, the rotation shaft 393*a* of the worm 393 and the drive shaft 395*a* of the motor M2 are formed as separate members, which are connected to be driven by a gear. According to the present embodiment, the rotation shaft 393*a* is arranged approximately in parallel with the drive shaft 395*a* at a position separated from the drive shaft 395*a*. Then, the gear 394 is fixed to the end portion of the rotation shaft 393*a*, and the pressure drive gear 395 fixed to the drive shaft 395*a* is meshed with the gear 394. Further, the gear 394 and the pressure drive gear 395 are spur gears. Therefore, even if a thrust force is applied on the worm 393 and the rotation shaft 393*a* by the reaction force from the cam, the thrust force acting on the internal component of the motor M2 can be reduced, and the deterioration of durability of the motor M2 can be suppressed.

Further, since both sides of the worm 393 are supported by the pair of bearings 399, the thrust force acting on the worm 393 and the rotation shaft 393*a* is received by the pair of bearings 399. From this arrangement, the thrust force acting on the internal components of the motor M2 can also be reduced. When the motor M2 is driven, the reaction force applied to the worm 393 from the worm wheel 392 meshing with the worm 393 prevents the worm 393 from easily separating from the worm wheel 392, and the drive transmission efficiency can be enhanced.

Further according to the present embodiment, the rotation speed of the drive shaft 395*a* of the motor M2 is reduced by the worm gear 401, so that the reduction ratio can be increased without using multiple gears. For example, it may be possible to arrange multiple idler gears between the gear 394 and the pressure drive gear 395 to achieve a reduction ratio, but such arrangement increases the size of the apparatus. The present embodiment enables to increase the reduction ratio without arranging multiple idler gears, so that the apparatus can be downsized. Thus, the present embodiment enables to provide the drive transmission device 400 and the pressure driving device 391 capable of changing the pressing force of the nip portion while enabling to save energy and reduce the apparatus size.

Durability of Fixing Unit Regarding Maintenance

Figure 12:
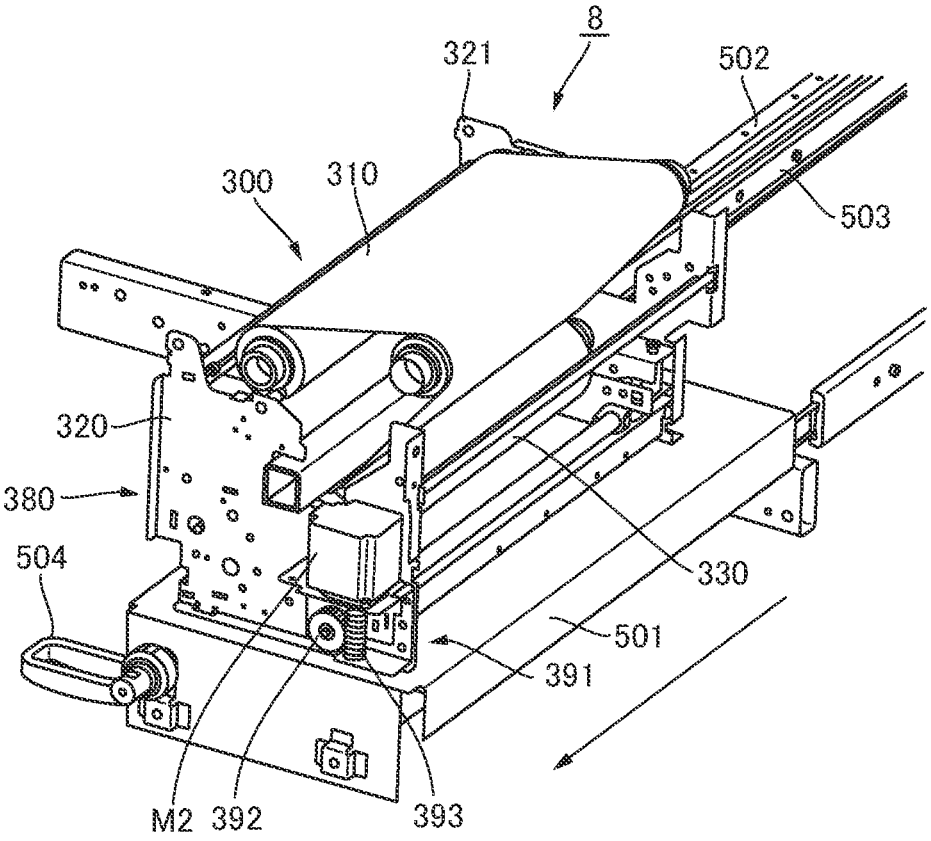
FIG. 12 is a perspective view illustrating a state where a fixing unit according to the embodiment is drawn out from the apparatus body from a front side.

Next, the durability of the fixing unit 8 regarding maintenance will be described with reference to FIGS. 12 and 13. As illustrated in FIG. 12, according to the present embodiment, in consideration of the maintenance property of the pressure driving device 391, the heating unit 300 and the pressure roller 330, the fixing unit 8 is formed as a unit that is detachably attached to the casing 3*a* (refer to FIG. 1) of the image forming apparatus 1.

Therefore, the fixing unit 8 is placed on a fixing drawer 501, and the fixing drawer 501 is configured to be drawable from inside the casing 3*a* to a predetermined outside position. A support rail 502 is provided between the fixing drawer 501 and the casing 3*a*, and a guide member 503 is attached to a rear surface of a side surface of the fixing drawer 501. A coupled driving wheel engaged with the support rail 502 is provided on the guide member 503. When drawing the fixing unit 8 out of the casing 3*a*, a front door not shown of the image forming apparatus 1 is opened, a lock lever 504 is operated, and the lock lever 504 is held to draw out the fixing drawer 501 to the front direction (arrow direction of FIG. 12). In this state, the fixing drawer 501 is guided by the guide member 503 and drawn out to the front side by the coupled driving wheel rotating on the support rail 502. In this state, the fixing unit 8 can be detached from and attached to the fixing drawer 501 for maintenance by holding a grip not shown.

Figure 13:
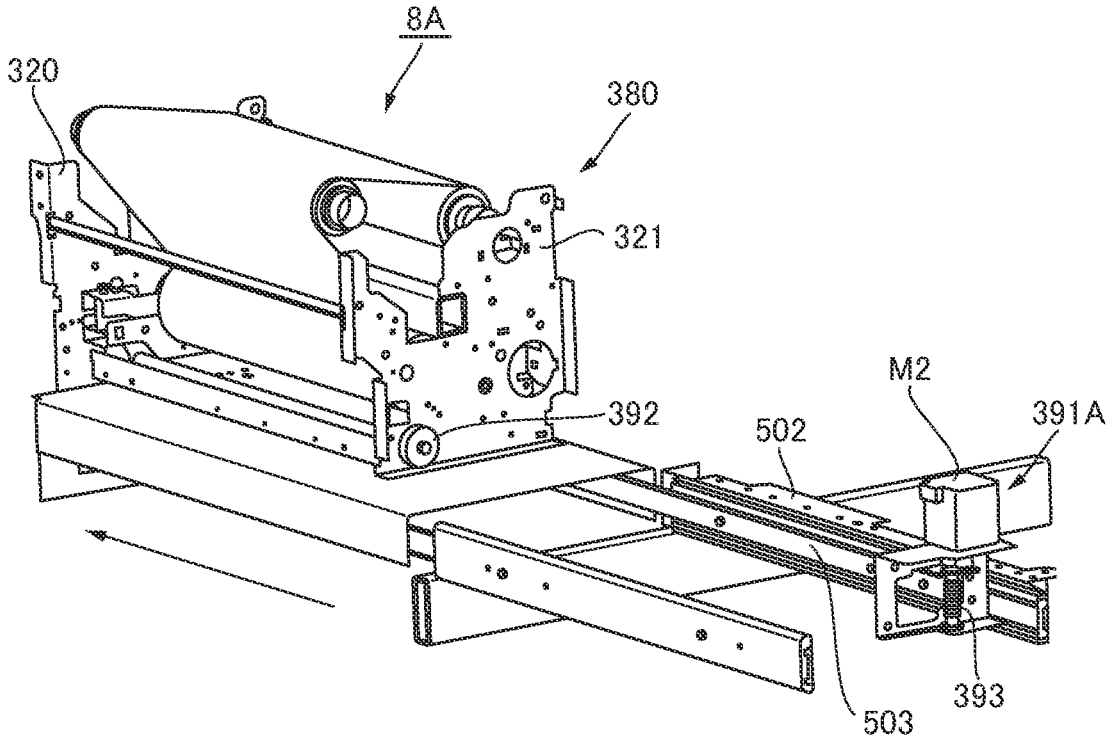
FIG. 13 is a perspective view illustrating a state where a fixing unit according to comparative example 2 is drawn out from the apparatus body from a rear side.

Now, a durability regarding maintenance of the fixing unit 8 will be examined with reference to a comparative example 2 illustrated in FIG. 13. In the comparative example 2, regarding the pressure driving device 391A for transmitting the drive from the motor M2 to the cam, members positioned downstream in the drive transmission direction of the worm wheel 392 including the worm wheel 392 are fixed to the fixing unit 8A, and the other members are provided on the casing 3*a*. In the comparative example 2, by drawing out or inserting the fixing unit 8A, the worm wheel 392 provided on the fixing unit 8A and the worm 393 provided on the casing 3*a* are disengaged or meshed. Therefore, the pressure driving device 391A is provided on the rear side plate 321 of the fixing frame 380.

According to the comparative example 2, during maintenance, when the fixing unit 8A having been drawn out is inserted to the casing 3*a*, the worm wheel 392 provided on the fixing unit 8A is meshed with the worm 393 provided on the casing 3*a* In this case, the phase of the worm wheel 392 may be deviated from the worm 393, and the tooth planes may collide against one another and damaged.

In contrast, according to the present embodiment, the pressure driving device 391 is fixed to the fixing frame 380. That is, the motor M2 and the drive transmission device 400 including the worm wheel 392 and the worm 393 are fixed to the fixing frame 380. Specifically, they are fixed to the front side plate 320 of the fixing frame 380. Therefore, even when attaching and detaching the fixing unit 8 with respect to the casing 3*a*, the worm wheel 392 and the worm 393 are moved together with the fixing unit 8. Therefore, the tooth planes of the worm wheel 392 and the worm 393 do not collide against one another when the fixing unit 8 is inserted to the casing 3*a*. Therefore, durability of the fixing unit 8 regarding maintenance can be ensured.

OTHER EMBODIMENTS

According to the embodiment described above, drive transmission between the drive shaft 395*a* of the motor M2 and the rotation shaft 393*a* of the worm 393 is performed by a gear, but a configuration using a pulley and a belt can also be adopted.

Further, the pressure roller 330 that forms the nip portion with the fixing belt 310 may also be a drive roller that abuts against the outer circumferential surface of the fixing belt 310 and rotates, to apply a driving force to the fixing belt 310. For example, the pressure roller 330 can adopt a configuration in which a gear is fixed to one end portion, and the pressure roller 330 is connected to a motor serving as a pressure roller driving source via the gear to be driven to rotate. In this case, the peripheral speed of the heating roller 340 should preferably set faster than the peripheral speed of the pressure roller 330. Further, a configuration can be adopted where the heating roller 340 is connected to a motor for driving the pressure roller 330 and driven to rotate.

According to the embodiment described above, the heating roller 340 is arranged downstream of the fixing pad 390 and upstream of the steering roller 350 with respect to the direction of rotation of the fixing belt 310. The position of the heating roller 340 can be changed with the position of the steering roller 350. That is, the heating roller 340 can be arranged downstream of the steering roller 350 and upstream of the fixing pad 390 with respect to the direction of rotation of the fixing belt 310.

According further to the embodiment described above, the member, i.e., nip portion forming member, that forms the nip portion with the pressure roller 330 to the fixing belt 310 is the fixing pad 390, but the nip portion forming member can also be a rotary member such as a roller. Further, the drive rotary member is the pressure roller 330 according to the embodiments, but the drive rotary member can also be a belt that is driven to rotate. That is, according to the embodiment, the first rotary member is the fixing belt 310 and the second rotary members is the pressure roller 330, but both the first and second rotary members can be belts. Further, both the first and second rotary members can be rollers.

According further to the embodiment described above, a configuration where the drive transmission device 400 is applied to the fixing unit has been described, but the drive transmission device 400 can be applied to other configurations as long as it is provided on a drive transmission path from a motor to a cam. For example, the drive transmission device 400 can be applied to a mechanism for lifting and lowering a recording material placed on a tray of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-114840, filed Jul. 2, 2020, and Japanese Patent Application No. 2021-101534, filed Jun. 18, 2021, which are hereby incorporated by reference herein in their entirety.

What is claimed is:

1. An image heating apparatus comprising:

a first rotary member that heats a recording material;

a second rotary member that contacts the first rotary member and forms a nip portion together with the first rotary member, the nip portion being configured to nip and convey a recording material to fix a toner image on the recording material;

a pair of side plates configured to support the second rotary member; and a changing mechanism configured to change a pressing force applied at the nip portion by changing a position of the second rotary member with respect to the first rotary member, wherein the changing mechanism comprises:

a motor;

a worm that is driven by the motor and rotates;

a worm wheel that is meshed with the worm and to which a driving force from the worm is transmitted;

a cam to which the rotation of the worm wheel is transmitted so that the cam rotates;

a pair of bearings that rotatably support the worm; and a displacement mechanism that is abutted against the cam and that is configured to displace the second rotary member with respect to the first rotary member along with a rotation of the cam, wherein one of the side plates includes the pair of bearings.

2. The image heating apparatus according to claim 1, further comprising:

a first drive transmission member that is attached to a shaft of the motor; and a second drive transmission member that is attached to a first end of the worm in the rotational axis direction of the worm and to which a driving force from the first drive transmission member is transmitted, wherein the first drive transmission member and the second drive transmission member are each a spur gear, and the first drive transmission member is configured to mesh with the second drive transmission member.

3. The image heating apparatus according to claim 1, wherein in a state where the image heating apparatus is removed from an image forming apparatus configured to support the image heating apparatus, the motor and the worm are configured to be removed integrally with the image heating apparatus.

4. The image heating apparatus according to claim 1, wherein the motor and the worm are supported by a first side plate of the pair of side plates.

5. The image heating apparatus according to claim 4, wherein in a state where the motor is a first motor, the image heating apparatus comprises a second motor configured to rotate at least the first rotary member or the second rotary member, and wherein the second motor is supported by a second side plate of the pair of side plates.

6. The image heating apparatus according to claim 1, further comprising:

a first drive transmission member that is attached to a shaft of the motor; and a second drive transmission member that is attached to a first end of the worm in the rotational axis direction of the worm and to which a driving force from the first drive transmission member is transmitted, wherein the first drive transmission member, the second drive transmission member, the worm and the worm wheel are made of metal.

7. The image heating apparatus according to claim 1, wherein the first rotary member is a belt, and the image heating apparatus further comprises a steering roller configured to stretch the belt and tilt, a pad configured to press the second rotary member via the belt, and a heating roller configured to stretch the belt and heat the belt.

8. The image heating apparatus according to claim 7, wherein the motor and the worm are supported by a first side plate of the pair of side plates, and a steering motor configured to tilt the steering roller is supported by a second side plate of the pair of side plates.

9. The image heating apparatus according to claim 8, wherein a motor configured to rotate at least the first rotary member or the second rotary member is supported by the second side plate.

10. The image heating apparatus according to claim 1, wherein the motor is arranged above the worm wheel in a vertical direction.

11. The image heating apparatus according to claim 1, wherein the worm wheel is configured to mesh with the worm between the pair of bearings.

12. The image heating apparatus according to claim 1, further comprising:

a first drive transmission member that is attached to a shaft of the motor; and a second drive transmission member that is attached to a first end of the worm in the rotational axis direction of the worm and to which a driving force from the first drive transmission member is transmitted.

13. The image heating apparatus according to claim 1, wherein the side plates include a support plate, and the pair of bearings are provided on the support plate.

14. An image heating apparatus comprising:

a first rotary member that heats a recording material;

a second rotary member that contacts the first rotary member and forms a nip portion together with the first rotary member, the nip portion being configured to nip and convey a recording material to fix a toner image on the recording material;

a pair of side plates configured to support the second rotary member; and a changing mechanism configured to change between application of pressure and releasing of application of pressure at the nip portion by changing a position of the second rotary member with respect to the first rotary member, wherein the changing mechanism comprises:

a motor;

a worm that is driven by the motor and rotates;

a worm wheel that is meshed with the worm and to which a driving force from the worm is transmitted;

a cam to which the rotation of the worm wheel is transmitted so that the cam rotates;

a pair of bearings that rotatably support the worm; and a displacement mechanism that is abutted against the cam and that is configured to displace the second rotary member with respect to the first rotary member along with a rotation of the cam, wherein one of the side plates includes the pair of bearings.

15. The image heating apparatus according to claim 14, further comprising:

a first drive transmission member that is attached to a shaft of the motor; and a second drive transmission member that is attached to a first end of the worm in the rotational axis direction of the worm and to which a driving force from the first drive transmission member is transmitted, wherein the first drive transmission member and the second drive transmission member are each a spur gear, and the first drive transmission member is configured to mesh with the second drive transmission member.

16. The image heating apparatus according to claim 14, wherein in a state where the image heating apparatus is removed from an image forming apparatus configured to support the image heating apparatus, the motor and the worm are configured to be removed integrally with the image heating apparatus.

17. The image heating apparatus according to claim 14, wherein the motor and the worm are supported by a first side plate of the pair of side plates.

18. The image heating apparatus according to claim 17, wherein in a state where the motor is a first motor, the image heating apparatus comprises a second motor configured to rotate at least the first rotary member or the second rotary member, and wherein the second motor is supported by a second side plate of the pair of side plates.

19. The image heating apparatus according to claim 14, further comprising:

a first drive transmission member that is attached to a shaft of the motor; and a second drive transmission member that is attached to a first end of the worm in the rotational axis direction of the worm and to which a driving force from the first drive transmission member is transmitted, wherein the first drive transmission member, the second drive transmission member, the worm and the worm wheel are made of metal.

20. The image heating apparatus according to claim 14, wherein the first rotary member is a belt, and the image heating apparatus further comprises a steering roller configured to stretch the belt and tilt, a pad configured to press the second rotary member via the belt, and a heating roller configured to stretch the belt and heat the belt.

21. The image heating apparatus according to claim 20, wherein the motor and the worm are supported by a first side plate of the pair of side plates, and a steering motor configured to tilt the steering roller is supported by a second side plate of the pair of side plates.

22. The image heating apparatus according to claim 21, wherein a motor configured to rotate at least the first rotary member or the second rotary member is supported by the second side plate.

23. The image heating apparatus according to claim 14, wherein the motor is arranged above the worm wheel in a vertical direction.

24. The image heating apparatus according to claim 14, further comprising:

a first drive transmission member that is attached to a shaft of the motor; and a second drive transmission member that is attached to a first end of the worm in the rotational axis direction of the worm and to which a driving force from the first drive transmission member is transmitted.

25. The image heating apparatus according to claim 14, wherein the side plates include a support plate, and the pair of bearings are provided on the support plate.

26. An image heating apparatus comprising:

a first rotary member that heats a recording material; and a second rotary member that contacts the first rotary member and forms a nip portion together with the first rotary member, the nip portion being configured to nip and convey a recording material to fix a toner image on the recording material;

a pair of side plates configured to support the second rotary member; and a changing mechanism configured to change a pressing force applied at the nip portion by changing a position of the second rotary member with respect to the first rotary member, wherein the changing mechanism comprises:

a motor;

a worm that is driven by the motor and rotates;

a worm wheel that is meshed with the worm and to which a driving force from the worm is transmitted;

a cam to which the rotation of the worm wheel is transmitted so that the cam rotates;

a bearing that rotatably supports the worm at a first position;

a displacement mechanism that is abutted against the cam and that is configured to displace the second rotary member with respect to the first rotary member along with a rotation of the cam, wherein one of the side plates includes the bearing.

27. The image heating apparatus according to claim 26, wherein the bearing rotatably supports the worm at an area further from the motor than a meshing position Where the worm meshes with the worm Wheel in the rotational axis direction of the worm.

* * * * *